US007262377B1

(12) United States Patent
Wei et al.

(10) Patent No.: US 7,262,377 B1
(45) Date of Patent: Aug. 28, 2007

(54) LIMIT SWITCH CONTROL DEVICE FOR AN ACTUATOR

(75) Inventors: Chia-Chun Wei, Taichung (TW); Yu-Jian Lin, Taichung (TW)

(73) Assignee: Hiwin Mikrosystem Corp., Taichung (TW)

( * ) Notice: Subject to any disclaimer, the term of this patent is extended or adjusted under 35 U.S.C. 154(b) by 0 days.

(21) Appl. No.: 11/563,018

(22) Filed: Nov. 23, 2006

(51) Int. Cl.
*H01H 3/16* (2006.01)

(52) U.S. Cl. ..... 200/47; 200/573

(58) Field of Classification Search ..... 200/1 R, 200/17 R, 18, 47, 33 B, 33 D, 52 R, 61.41, 200/61.42, 573, 574; 74/89.37, 526; 192/141, 192/143; 318/626, 266
See application file for complete search history.

(56) References Cited

U.S. PATENT DOCUMENTS 3,715,530 A * 2/1973 Dalton ..... 200/47
3,898,399 A * 8/1975 Yasui et al. ..... 200/47
4,330,052 A * 5/1982 Schymick ..... 192/148
4,829,148 A * 5/1989 Muller ..... 200/56 R
5,579,899 A * 12/1996 Arnold ..... 200/47
5,872,344 A * 2/1999 Durand et al. ..... 200/61.72
5,890,585 A * 4/1999 Nakamura et al. ..... 200/47
6,321,611 B1 * 11/2001 Szu et al. ..... 74/89.37
6,399,906 B1 * 6/2002 Sato et al. ..... 200/61.59
7,161,100 B1 * 1/2007 Hsieh ..... 200/47

* cited by examiner

*Primary Examiner*—Michael A Friedhofer
(74) *Attorney, Agent, or Firm*—Banger Shia

(57) ABSTRACT

A limit switch control device for an actuator is disposed at both ends of a linearly moveable mover and comprises at least: two limit switches, a circuit board, and a connecting rod assembly. The two limit switches are disposed on the circuit board, both ends of the connecting rod assembly define the effective travel length of the mover. One end of the connecting rod assembly is moved by the mover to control the other limit switch. By such arrangements, the limit switch is simplified, and with the arrangement of the connecting rod assembly, the number of the brake devices or the limit switches can be increased as desired. Further, the circuit board and the connecting rod assembly are modular designed.

5 Claims, 6 Drawing Sheets

LIMIT SWITCH CONTROL DEVICE FOR AN ACTUATOR

BACKGROUND OF THE INVENTION

1. Field of the Invention

The present invention relates to a limit switch control device, and more particularly to a limit switch control device for an actuator capable of controlling the limit switch by using the linearly moveable mover.

2. Description of the Prior Art

A conventional limit switch control device for an actuator is shown in FIG. 1 and generally comprises a fixing member 10 with a receiving space 11 for fixing two limit switches 12 at both ends thereof. There is a linearly movable mover on the actuator, and the two limit switches 12 are disposed at both ends of the fixing member 10 and located correspondingly to the travel path of the mover. Each of the limit switches 12 is connected to an electronic circuit 121. The electronic circuit 121 is connected to outside via the receiving space 11 of the fixing member 10. This conventional limit switch control unit can control the displacement of the mover when the mover contacts the limit switches 12 at both ends thereof, however, it still has the following problems:

First, the conventional limit switch 12 usually has the problem that the electronic circuit 121 is too long, so that the resultant material cost is relatively high.

Second, the distance between the two limit switches 12 must change with the travel distance of the mover. When the distance between the two limit switches 12 changes, the electronic circuits 121 must also be adjusted synchronously, and as a result, the length of the electronic circuits must be changed.

Third, the two conventional limit switches 12 must cooperate with various mechanisms to adjust the distance therebetween, therefore, relative electronic elements should also be directly welded to the limit switches 12, for facilitating the adjustment of different design. However, the electronic elements are difficult to weld, and the welding precision is difficult to control.

Fourth, the respective limit switches 12 are only provided with a circuit breaker used to stop the mover, but don't have a short brake function. Therefore, when the limit switch control device is switched off, the mover will still move out of the predetermined travel path because of inertia.

The present invention has arisen to mitigate and/or obviate the afore-described disadvantages.

SUMMARY OF THE INVENTION

The primary objective of the present invention is to provide a limit switch control device for an actuator with a small number of electronic circuits, wherein the limit switch and the length of the electronic circuit don't need to be adjusted frequently.

The secondary objective of the present invention is to provide a limit switch control device for an actuator, wherein the electronic elements are easy to weld, and the welding precision is easy to control.

Yet another objective of the present invention is to provide a limit switch control device for an actuator with brake function and extension design.

To achieve the abovementioned objective, a limit switch control device for an actuator in accordance with the present invention is disposed at both ends of a linearly moveable mover and comprises at least: two limit switches, a circuit board, and a connecting rod assembly; wherein:

the two limit switches are disposed on the circuit board, the circuit board is disposed on a stator of the actuator, the mover of the actuator triggers one of the limit switches at a start position of the mover's travel path;

the connecting rod assembly includes two fixing members, a connecting rod, and at least one elastic member, the two fixing members are fixed at both ends of the connecting rod, each of the fixing members is provided with a driving portion located correspondingly to a predetermined travel path of the mover, a driving portion of the fixing member at an end position of the mover's travel path serves to interfere with the mover, the driving portion of the fixing member at the start position of the mover's travel path is located between the two limit switches, the elastic member (such as spring, leaf spring, or elastic block) is located between the driving portion of the fixing member and the limit switch at the start position of the mover's travel path, the connecting rod assembly cooperates with the elastic member to provide a brake function to the mover when the mover moves to the start position or the end position of the mover's travel path, an abutting protrusion with a guiding slope is formed on the fixing member at the start position of the mover's travel path, and the abutting protrusion serves to trigger the other limit switch.

Especially, the two limit switches are juxtaposed and fixed on the welding points of the circuit board, the fixing members at both ends of the connecting rod assembly are driven to move by the mover, so that not only the mover itself will trigger at least one of the limit switches, the displacement of the connecting rod assembly can control the other limit switch. At the same time, the connecting rod assembly cooperates with the elastic member to produce a brake function for the mover.

By such arrangements, the present invention simplifies the limit switch, and with the arrangement of the connecting rod assembly, the number of the brake devices or the limit switches can be increased as desired. Further, the circuit board and the connecting rod assembly are modular designed.

DETAILED DESCRIPTION OF THE PREFERRED EMBODIMENTS

The present invention will be more clear from the following description when viewed together with the accompanying drawings, which show, for purpose of illustrations only, the preferred embodiment in accordance with the present invention.

Figure 1:
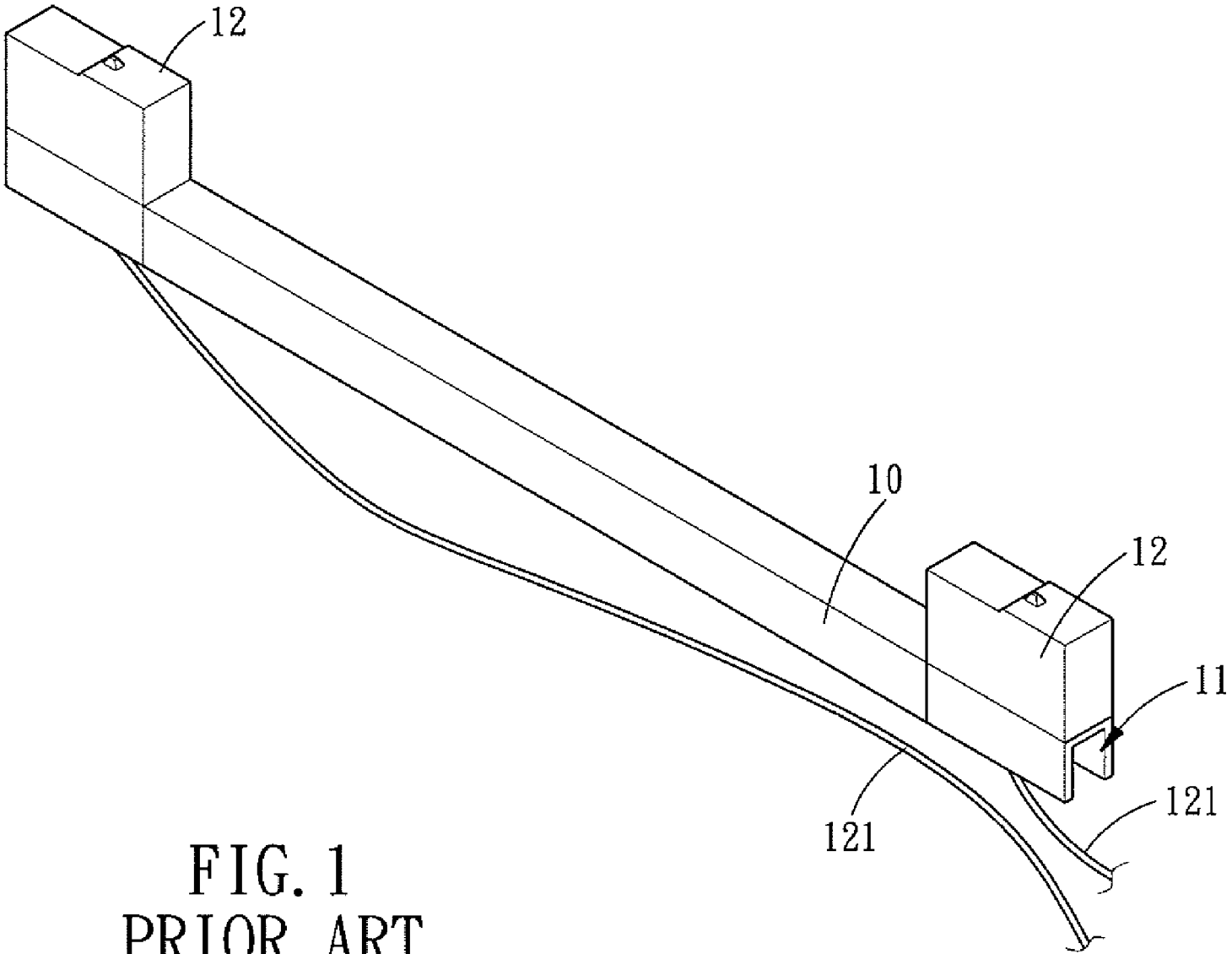
FIG. 1 PRIOR ART
FIG. 1 is an illustrative view of a conventional limit switch control device for an actuator.
Figure 2:
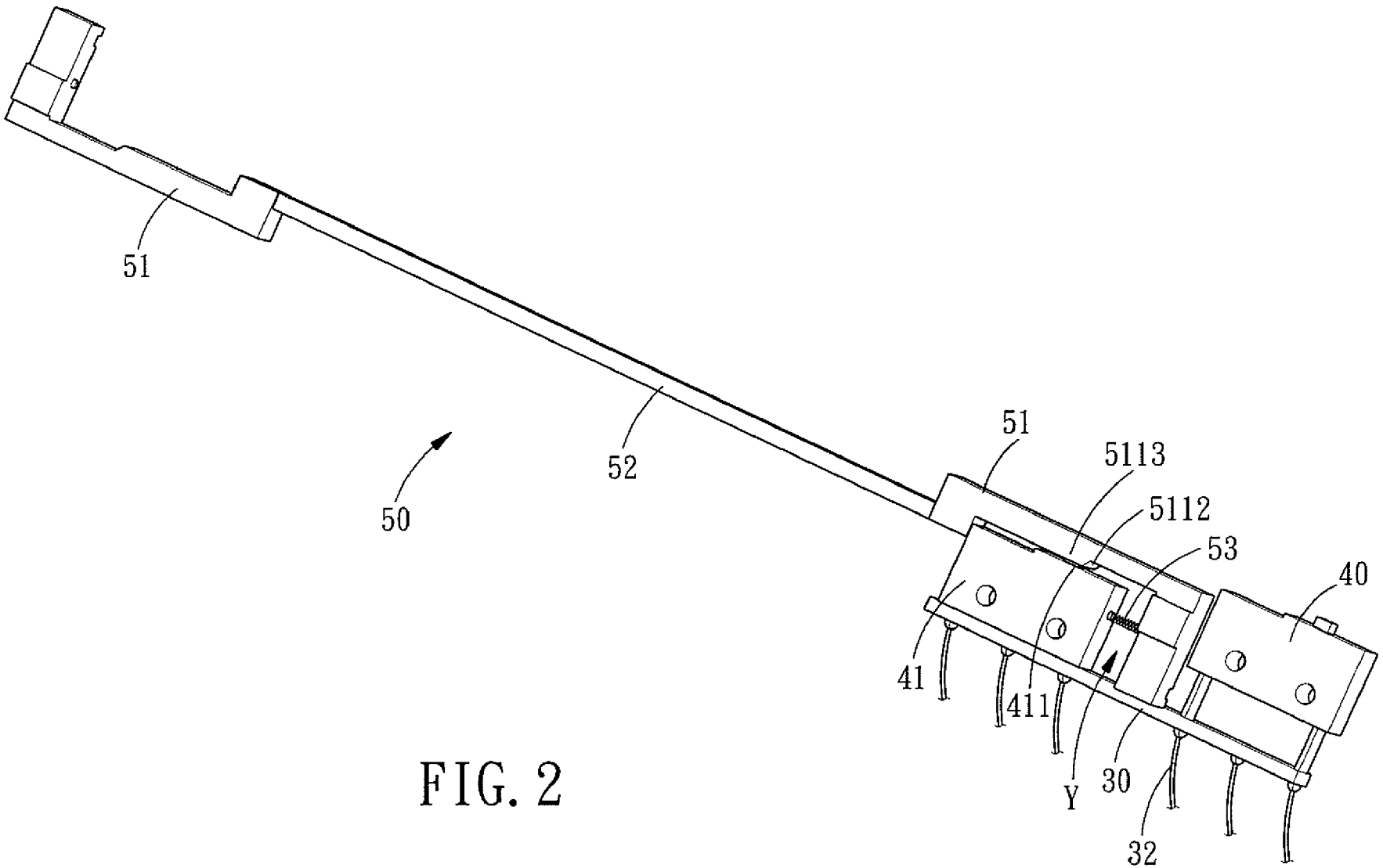
FIG. 2 is an assembly view of a limit switch control device for an actuator in accordance with the present invention.
Figure 3:
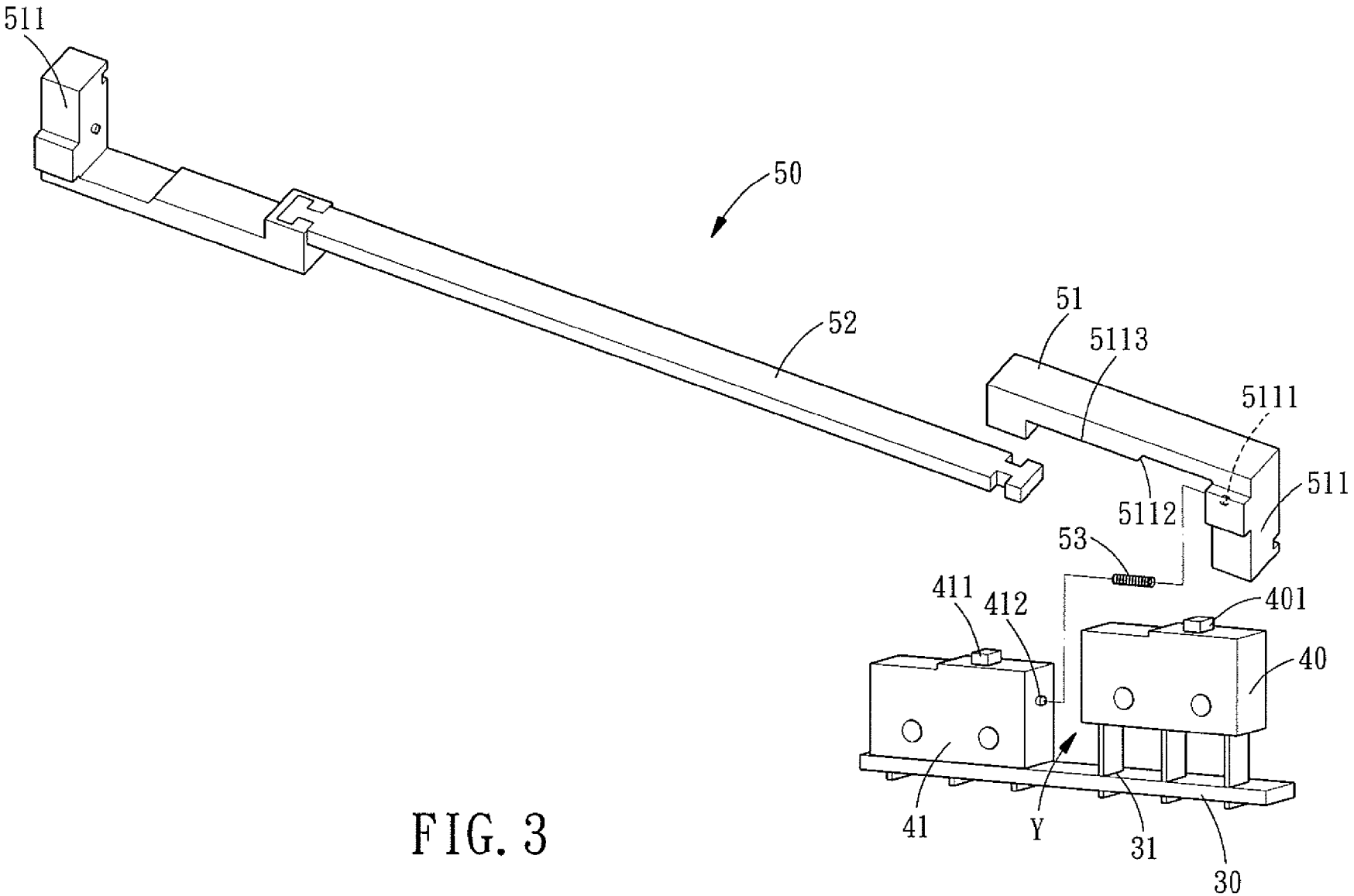
FIG. 3 is an exploded view of the limit switch control device for an actuator (including the electronic circuits) in accordance with the present invention.
Figure 4:
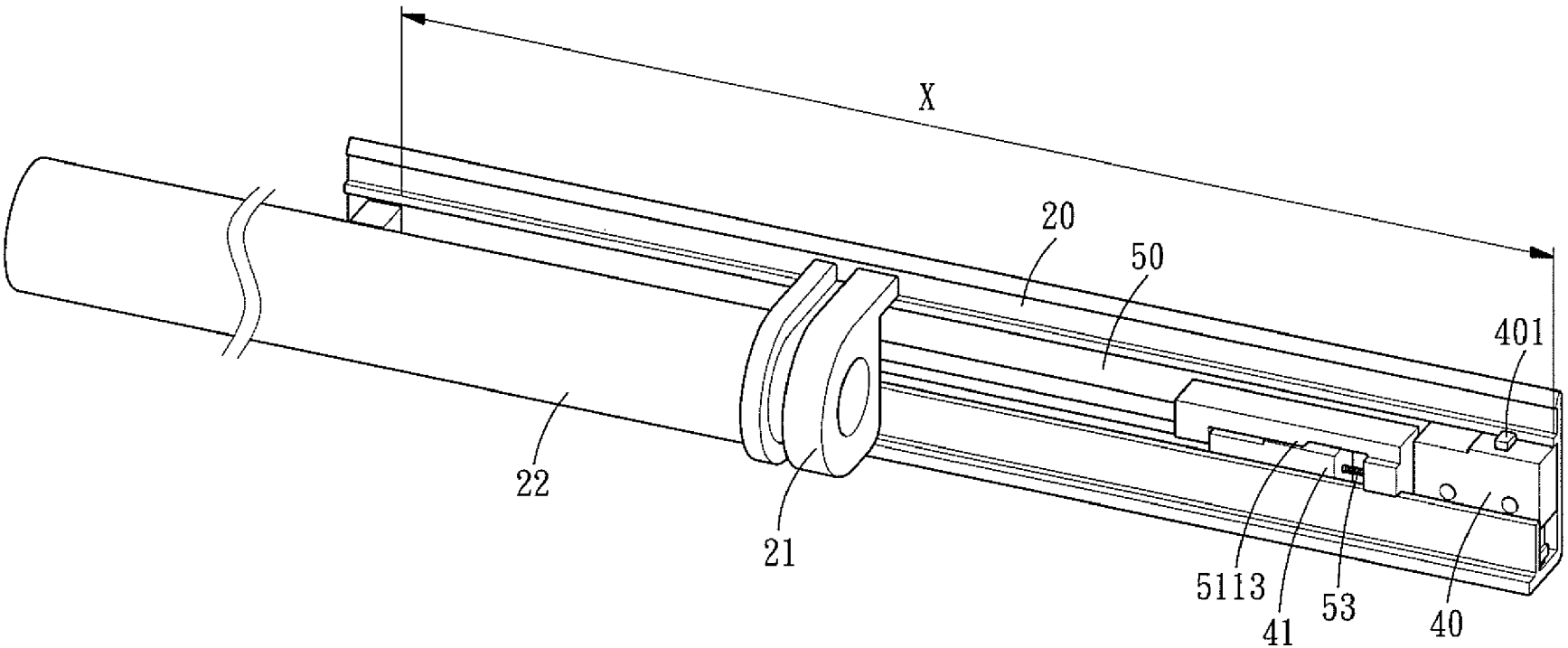
FIG. 4 shows that the limit switch control device of the present invention is assembled to the stator and the mover.

Referring to FIGS. 2, 3 and 4, a limit switch control device for an actuator in accordance with the present invention is disposed on a stator 20, and a linearly moveable mover 21 is slideably mounted on the stator 20. On the mover 21 is disposed a working rod 22. The mover 21 has a predetermined travel path X located correspondingly to the stator 20. The limit switch control device for an actuator in accordance with the present invention comprises: a circuit board 30, two limit switches 40, 41, and a connecting rod assembly 50.

A plurality of welding points 31 and electronic circuits 32 are disposed on the circuit board 30, and the electronic circuits 32 are connected between the control system and the welding points 31. The circuit board 30 is disposed at an end of the predetermined travel path X of the mover 21.

The limit switches 40 and 41 are juxtaposed and fixed on the welding points 31 of the circuit board 30, and a predetermined working space Y is defined between the limit switches 40 and 41. A positioning protrusion 412 is formed on the limit switch 41 and is located toward the working space Y. Each of the limit switches 40 and 41 is provided with a trigger 401, 411 located correspondingly to the predetermined travel path X of the mover 21. The triggers 401 and 411 are to be triggered by the mover 21.

The connecting rod assembly 50 includes two connecting fixing members 51, a connecting rod 52 and a spring 53. Each of the fixing members 51 is provided with a driving portion 511 that extends outward and is located correspondingly to the travel path X of the mover 21. The connecting rod 52 has a concave-convex structure formed at either end thereof for engaging with fixing members 51. The two fixing members 51 are located opposite each other. The start position and the end position of the mover 21 are located between the two fixing members 51. The driving portion 511 of the fixing member 51 at the start position is received in the working space Y between the two limit switches 40 and 41, and is provided with a positioning protrusion 5111 located toward the limit switch 41. The spring 53 is mounted on the positioning protrusion 5111 and the positioning protrusion 412 of the limit switch 41 and is biased between the driving portion 511 of one of the fixing members 51 and the limit switch 41. An abutting protrusion 5113 with a guiding slope 5112 is formed on the driving portion 511 and is located correspondingly to the trigger 411 of the limit switch 41.

Figure 5:
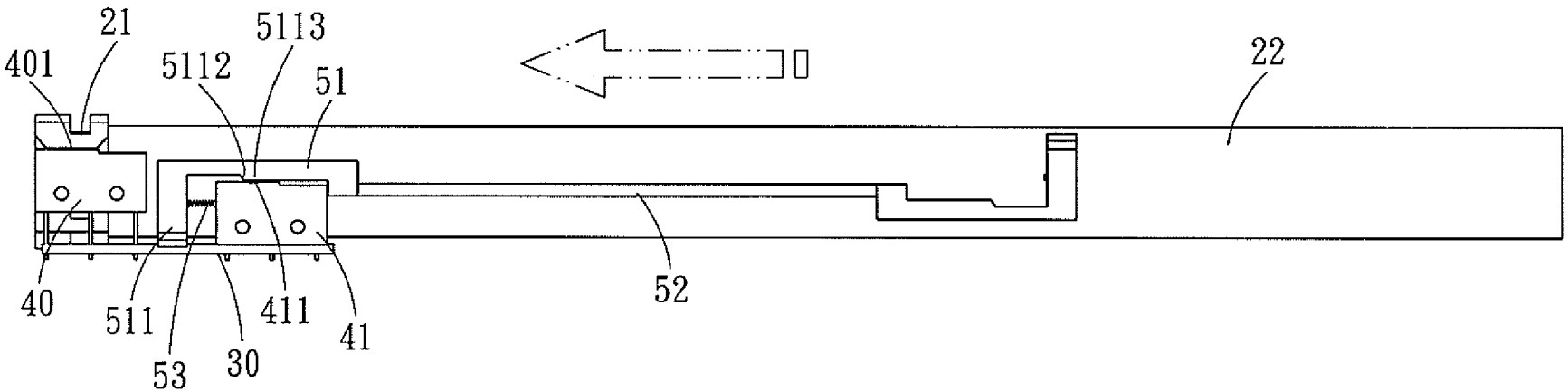
FIG. 5 is an operational view in accordance with the present invention of showing the status of circuit break when the mover moves to the start position.
Figure 6:
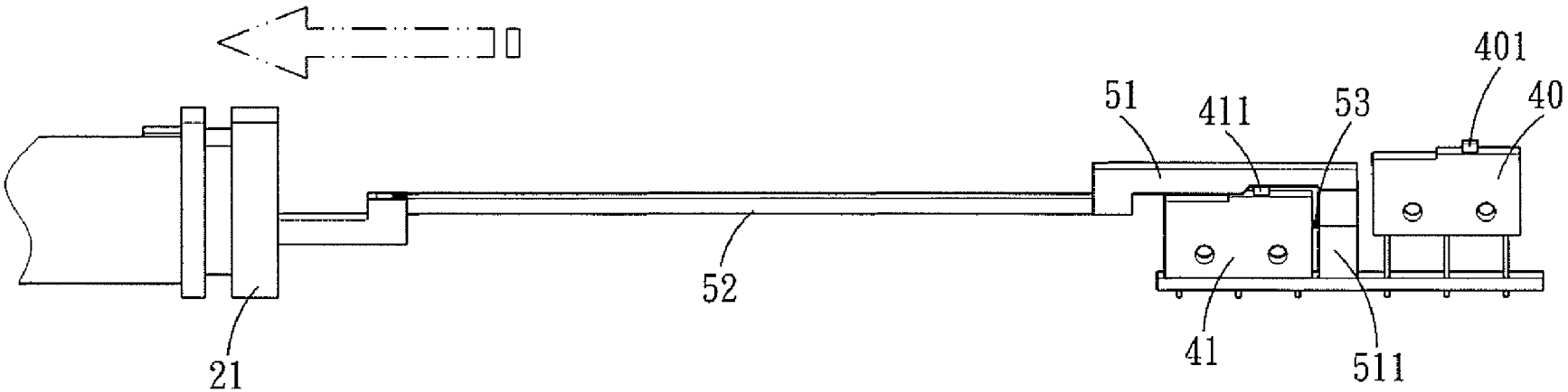
FIG. 6 is an operational view in accordance with the present invention of showing the status of circuit break when the mover moves to the end position.

For a better understanding of the present invention, its operation and function, reference should be made to FIGS. 5 and 6.

The limit switches are installed on the stator 20, and on the stator 20 is further disposed a linearly movable mover 21 that moves back and forth along the predetermined travel path X. The two limit switches 40 and 41 are positioned at the start position and the end position of the mover's 21 travel path to control the mover 21.

When the mover 21 is located at the start position, only the trigger 401 of the limit switch 40 will be pressed down by the mover 21 and maintained in the normal close state. At this moment, the other limit switch 41 will be pressed down by the abutting protrusion 5113 of the fixing member 51 and maintained in the normal close state. When the mover 21 moves back to its start position, the trigger 401 of the limit switch 40 will be pressed down by the mover 21 and will return to the normal close state from the previous normal open state. At this moment, the control circuit will produce a signal to stop the power through the circuit board 30 and the electronic circuits 32, thus carrying out the control operation.

When the mover 21 moves to the end position, since the pushing force of the mover 21 will interfere with the driving portion 511 of the other fixing member 51, at this moment, the connecting rod assembly 50 will be driven to move by the mover 21. And the abutting portion 5113 on the fixing member 51 at the start position will use the guiding slope 5112 to release the trigger 411 of the limit switch 41, so that the limit switch 41 will return to the normal open state from the previous normal close state. At this moment, the control circuit will produce a stop signal to stop the power again, thus stopping the mover 21.

Meanwhile, since the driving portion 511 of the fixing member 51 at the start position is received in the working space Y between the limit switches 40 and 41, and the spring 53 is biased between the driving portion 511 of the fixing member 51 and one of the limit switches 41. Therefore, the inertia force of the mover 21 will be absorbed by the spring 53 (thus producing a brake effect).

Finally, when the inertia force and the pushing force of the mover 21 disappear, the compression force of the spring 53 will be released, the connecting rod assembly 50 will return to the start position automatically, the limit switch 41 will return to the normal close state from the previous normal open state, and the control system is ready for the next operation (for example, automatic reverse displacement).

The limit switch control device for an actuator in accordance with the present invention is simply structured, the limit switch and the length of the electronic circuit don't need to be adjusted frequently. In addition, the electronic elements are easy to weld, the welding precision thereof is easy to control, and the connecting rod assembly provides an extension function.

While we have shown and described various embodiments in accordance with the present invention, it is clear to those skilled in the art that further embodiments may be made without departing from the scope of the present invention.

What is claimed is:

1. A limit switch control device for an actuator comprising at least: two limit switches, a circuit board, and a connecting rod assembly; wherein:

the two limit switches are disposed on the circuit board, the circuit board is disposed on a stator of the actuator, a mover of the actuator triggers one of the limit switches at a start position of the mover's travel path;

the connecting rod assembly includes two fixing members, a connecting rod, and at least one elastic member, the two fixing members are fixed at both ends of the connecting rod, each of the fixing members is provided with a driving portion located correspondingly to a predetermined travel path of the mover, a driving portion of the fixing member at an end position of the mover's travel path serves to interfere with the mover, the driving portion of the fixing member at the start position of the mover's travel path is located between the two limit switches, the elastic member is located between the driving portion of the fixing member and the limit switch at the start position of the mover's travel path, the connecting rod assembly cooperates with the elastic member to provide a brake function to the mover when the mover moves to the start position or the end position of the mover's travel path, an abutting protrusion with a guiding slope is formed on the fixing member at the start position of the mover's travel path, and the abutting protrusion serves to trigger the other limit switch.

2. The limit switch control device for an actuator as claimed in claim 1, wherein:

a plurality of welding points and electronic circuits are disposed on the circuit board, and the electronic circuits are connected between a control system and the welding points, the circuit board is disposed at the start position and the end position of the predetermined travel path of the mover;

the two limit switches are juxtaposed and fixed on the welding points of the circuit board, and a predetermined working space is defined between the limit switches, each of the limit switches is provided with a trigger located correspondingly to the predetermined travel path of the mover;

the connecting rod of the connecting rod assembly has a concave-convex structure formed at either end thereof for engaging with the members, the two fixing members are located opposite each other, the driving portion of the fixing member at the start position of the mover's travel path is received in the working space between the two limit switches, and the elastic member is also received in the working space.

3. The limit switch control device for an actuator as claimed in claim 1, wherein the elastic member includes spring, leaf spring, or elastic block.

4. The limit switch control device for an actuator as claimed in claim 2, wherein the elastic member is a spring.

5. The limit switch control device for an actuator as claimed in claim 4, wherein a positioning protrusion is formed on one of the limit switches and is located toward the working space, a driving portion of the fixing member at the start position of the mover's travel path is provided with a positioning protrusion located toward the working space, and the spring is biased between the limit switch and the positioning protrusion of the limit switch.

* * * * *